United States Patent [19]

Bennett et al.

[11] 4,068,630

[45] Jan. 17, 1978

[54] ENGINE WITH NOISE REDUCING EXHAUST VALVE ARRANGEMENT

[75] Inventors: David E. Bennett, Westland; Terrence S. Trasatti, Sterling Heights; Lawrence D. Peterson, Detroit, all of Mich.

[73] Assignee: General Motors Corporation, Detroit, Mich.

[21] Appl. No.: 640,054

[22] Filed: Dec. 12, 1975

[51] Int. Cl.[2] ..... F02B 75/02

[52] U.S. Cl. ..... 123/75 C; 123/90.17; 123/188 S

[58] Field of Search ..... 123/65 V, 65 A, 65 VC, 123/75 B, 75 C, 90.17, 188 S

[56] References Cited

U.S. PATENT DOCUMENTS

| | | | |
|---|---|---|---|
| 640,394 | 1/1900 | Lewis | 123/75 C |
| 1,614,709 | 1/1927 | Baster | 123/75 B |
| 1,896,163 | 2/1933 | Champion | 123/75 C |
| 1,927,311 | 9/1933 | Goldberg | 123/79 C |
| 3,918,420 | 11/1975 | Villella | 123/75 C |
| 3,938,482 | 2/1976 | Akamatsu | 123/75 C |

*Primary Examiner*—Charles J. Myhre
*Assistant Examiner*—Craig R. Feinberg
*Attorney, Agent, or Firm*—Robert J. Outland

[57] ABSTRACT

An arrangement for reduction of exhaust noise in an internal combustion engine comprising in a preferred embodiment a two-cycle diesel engine having two or more exhaust valves per cylinder and separate cam lobes for actuating two groups of one or more valves. The lobes are arranged to stagger the openings of the two valves or groups of valves and to close all valves in a cylinder at the same time. The gas flow area past the earliest opening valve during the period before the second valve opens is controlled to restrict exhaust gas flow, thus limiting the exhaust blowdown pulse and exhaust noise from that source. Preferably, the initial flow restriction is provided by seating the early opening valve heads in countersunk seats with a predetermined radial clearance around the head which acts to restrict the flow in the initial opening period.

4 Claims, 4 Drawing Figures

ENGINE WITH NOISE REDUCING EXHAUST VALVE ARRANGEMENT

This invention relates to internal combustion engines and more particularly to exhaust valve arrangements for engines having multiple exhaust valves per cylinder, particularly two-cycle diesel engines.

It is known in the art that one substantial cause of exhaust noise in internal combustion engines is the pulsed gas flow in the exhaust system caused by the periodic opening and closing of the exhaust valves. A significant portion of this noise is believed attributable to the initial surges of gas called blowdown pulses which issue from the cylinder upon the opening of the exhaust valve or valves at a time when the cylinder pressure is still relatively high. This blowdown pulse phenomenon occurs in nearly all internal combustion engines, since they are not usually arranged or operated in a manner that permits expansion of the cylinder gases to atmospheric pressure before opening of the exhaust valves. The phenomenon is generally more noticeable in diesel engines which are usually unthrottled and is especially severe in two-cycle engines of the type in which the exhaust valves are opened relatively early in the expansion stroke to permit exhaust blowdown to occur before the intake ports are opened.

The present invention provides an arrangement for reducing the severity of exhaust blowdown pulses in engines that are provided with more than one exhaust valve per cylinder and means for separately actuating those valves. Although usable with both two and four-stroke engines of the gasoline and diesel type, it is thought the benefits of the invention will be most pronounced when applied to two-stroke cycle diesel engines of the well known uniflow scavenged, ported intake design having multiple exhaust valves in each cylinder.

It is a feature of the invention that it provides means for opening the exhaust valves of each cylinder in staggered fashion, with one valve or group of valves being opened slightly in advance of the other valve or group of valves. It is another feature of the invention that the period of initial opening of the first valve group involves controlling the opening area to restrict exhaust blowdown.

An optional feature of the invention is that a controlled restriction of the initial opening of the early opening valve or valves may be provided by recessing or countersinking the valve seats of the earliest opening valves and providing a predetermined limited clearance around these valve heads when near their closed positions. Yet another feature of the invention is that the exhaust valves of each cylinder are closed coincidentally to avoid adversely affecting cylinder charging or shortening the compression stroke.

Still another feature of the invention is that the two groups of valves in each cylinder may be actuated by separate cam lobes from a common camshaft. The lobes are formed with differing lift curves and timed to provide the desired staggered opening and coincidental closing of the two valve groups.

These and other features of the invention will be more fully understood from the following description of a preferred embodiment of the invention illustrated in the accompanying drawing in which.

Figure 1:
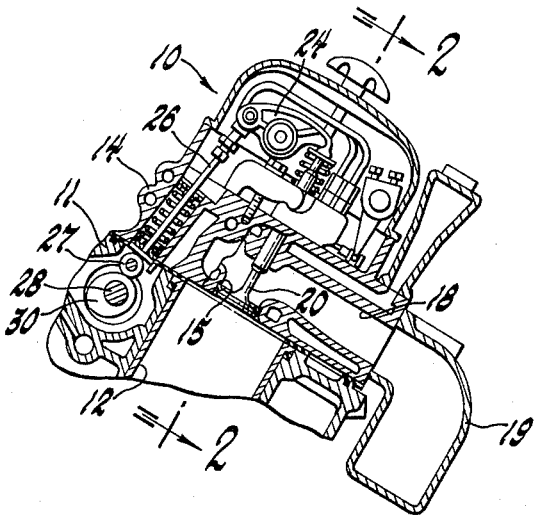
FIG. 1 is a fragmentary cross-sectional view of a two-stroke cycle uniflow scavenged diesel engine having an exhaust valve arrangement according to the present invention.

Referring now in detail to the drawing, numeral 10 generally indicates an internal combustion engine of the two-stroke cycle, uniflow scavenged diesel type well known in the art and of which FIG. 1 illustrates only a pertinent fragmentary portion of one cylinder bank. Engine 10 includes the usual cylinder block 11 providing a plurality of cylinders defined by removable liners 12 having ports, not shown, for the admission of air in known fashion.

The ends of the cylinders in each bank are closed by a cylinder head 14 which includes for each cylinder a pair of exhaust ports 15, 16 connecting with the cylinder and with a common lateral exhaust passage 18 that opens through the side of the head and connects with an exhaust manifold 19. The manifold in turn may connect with atmosphere through the usual exhaust pipe, not shown.

The cylinder head also carries for each cylinder a pair of exhaust valves 20, 22 of the poppet type which include heads adapted to seat against valve seats in the exhaust ports 15, 16, respectively. Valves 20, 22 are movable in known fashion to open or close the irrespective exhaust ports to the passage of exhaust gases therethrough. Intermediate the valves, the cylinder head carries a fuel injector 23 at each cylinder location.

Each of the valves and the fuel injectors are separately actuated by cylinder head mounted rocker arms 24 which connect through push rods 26 and roller followers 27 with a camshaft 28 rotatably mounted in the cylinder block and driven from the engine crankshaft, not shown, at the speed of the crankshaft and in timed relation therewith. The camshaft includes a separate cam lobe 30 for actuating each of the valves and for each injector.

Figure 4:
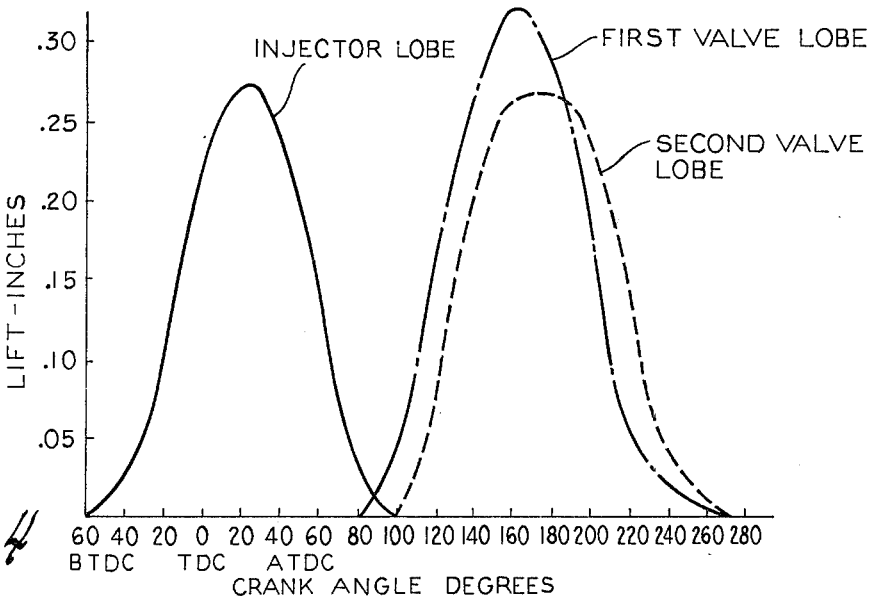
FIG. 4 is a cam lobe lift diagram comparing the lift curves for the cam lobes of the staggered exhaust valves of one cylinder of an engine according to the invention.

Each of the cam lobes of a cylinder has a different shape and timing relationship, as is shown in FIG. 4. There it is seen that the injector lobe moves the injector plunger during the period of crankshaft rotation from 60° before the top dead center to 100° after top dead center. The two exhaust cam lobes are arranged to stagger the valve openings, with the first valve beginning to open about 80° after top center, while the second valve begins to open near 100° after top center. These figures do not take into account the effects of valve lash and valve train distortion which may alter the actual valve timing figures somewhat. Both cam lobes are arranged to close their respective valves coincidentally about 270° after top center. The rates of valve lift and closing are about the same for both lobes; and, since the earlier opened valve 20 is open for a longer period, its lift is also somewhat higher than that of the second opened valve 22.

Figure 2:
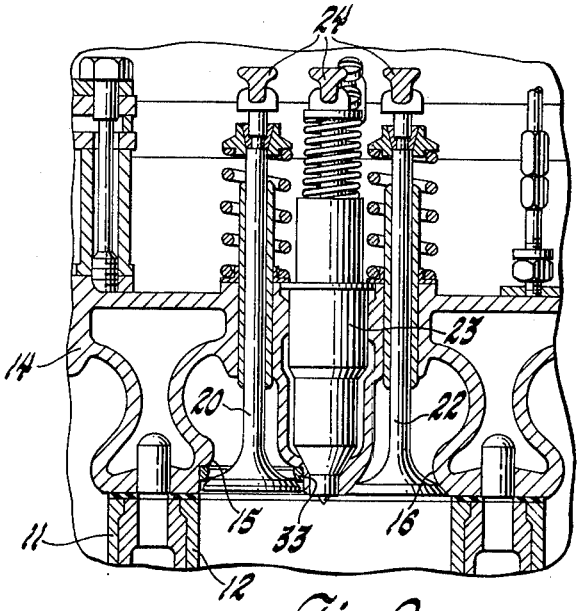
FIG. 2 is a fragmentary cross-sectional view from the plane indicated by the line 2—2 of FIG. 1 and illustrating portions of the novel exhaust valve arrangement.

Referring now to FIG. 2 of the drawing, it may be noted that the valves 20, 22 are seated somewhat differently in the cylinder head. Valve 22 is conventionally seated with the head of the valve approximately flush with the lower face of the cylinder head. With this arrangement, the gas flow area through the port when the valve is opened is determined, essentially, only by the amount of lift of the valve.

Figure 3:
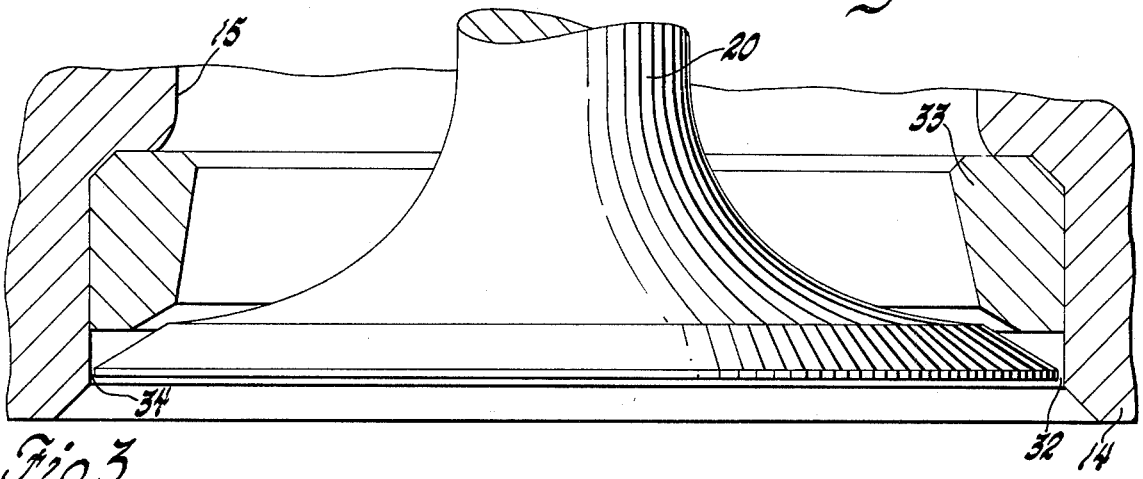
FIG. 3 is an enlarged view of a portion of FIG. 2 showing the recessed valve head and seat arrangement of the early opening valve.

The situation differs with respect to valve 20, the pertinent portions of which are shown enlarged in FIG. 3. Here, the face of the cylinder head 14 is recessed at 32, and a valve seat is formed by an insert 33 located in the recess 32. Thus, when valve 20 is closed or only slightly opened, as is shown in FIG. 3, the head of the valve is within the recess 32. The diameter of the recess 32 is slightly larger than the diameter of the valve head so as to provide a predetermined radial clearance 34 between the valve head and the recess 32.

The length of the recess 32 and the position of the valve insert 33 are such that the head of the valve remains within the recess during its initial opening period from the time of its opening to about the time when the other valve 22 begins to open. Thus, during this period the gas flow area through the port 15 is determined primarily by the size of the clearance 34, irrespective of the lift of the valve 20. After the initial opening period, however, the head of the valve 20 moves out of the recess 32 and the gas flow area for the port is enlarged, as a function of the subsequent valve lift, until the maximum opening is reached.

The result of the above arrangement on the operation of the engine is as follows:

Injection of fuel by the injector near the end of the compression stroke of the piston, not shown, causes burning and expansion of the burned gases on the expansion stroke of the piston. At 80° after top center, valve 20 beings to open, moving downwardly with its head remaining within the recess 32. During this period the radial clearance 34 provides a limited annular flow path through which the relatively high pressure gases in the cylinder are allowed to pass, but at a controlled rate due to the annular restriction. Thus, the cylinder pressure is reduced with an initial blowdown period in which the rate of flow is restricted by the recessed construction of the first opened valve.

When the piston moves to about 100 crank angle degrees after top center, the second valve 22 begins to open. Also at about this time, the head of the first opened valve 20 begins to move out of the recess 32. From this point on, the flow area for discharge of gases through the exhaust ports increases rapidly until the valves are fully opened, and the major portion of the cylinder exhaust gas is scavanged out by a fresh charge of air entering through the liner intake ports, not shown. The scavenging process is cut off by the coincident closing of both valves at about 270° after top center, at which point compression of the fresh charge begins and the cycle is repeated.

It should be apparent that the illustrated embodiment represents only one arrangement for utilizing the concepts of the present invention. In this embodiment the exhaust blowdown pulse is limited by allowing one of the exhaust valves to open earlier than the other and recessing this valve to provide a fixed restriction to flow during the initial phase of its opening movement. Such an arrangement could also be applied, however, to cylinder heads having four valves or any other number more than one where there is provision for separate actuation of the valves in two groups, one of which would have recessed valves opened earlier than the other. Also, if desired, the use of the recessed valves could be dispensed with and the control of opening area in the initial phase of the first opening valve or valves could be obtained by proper design of the initial lift curve of the cam lobe actuating the earlier opening valves.

Since these and many other modifications of the disclosed embodiment could be made within the scope of the present invention, it is intended that the invention not be limited by the disclosure, but that it have the full scope permitted by the language of the following claims.

We claim:

1. The combination in an internal combustion engine of a cylinder having a plurality of parallel exhaust ports defining separate passages through an end wall thereof, each passage being directly connected to a common exhaust passage, poppet valves, one for each port, actuatable to periodically close or open their respective ports, and means for actuating said valves in timed relation to engine operation and operable to open at least a first one of said valves slightly in advance of at least a second one of said valves and to maintain said valves open simultaneously for the major portions of their open periods, said actuating means controlling the initial opening motion of said first valve to provide a predetermined limited time-area opening in advance of the opening of said second valve, whereby exhaust flow is restricted during the initial opening period of said first valve, thus reducing the cylinder pressure by limiting exhaust gas flow in advance of the opening of said second valve and the wider opening of said first valve so that the exhaust blowdown pulse is controlled and exhaust noise is thereby limited.

2. The combination of claim 1 wherein said actuating means are further operable to provide substantially coincidental closing of both said first and second valves.

3. The combination in an internal combustion engine of a cylinder having a plurality of parallel exhaust ports defining separate passages through an end wall thereof, each passage being directly connected to a common exhaust passage, poppet valves, one for each port, actuatable to periodically close or open their respective ports, and means for actuating said valves in timed relation to engine operation and operable to open at least a first one of said valves slightly in advance of at least a second one of said valves and to maintain said valves open simultaneously for the major portions of their open periods, said first valve having a head recessed in said end wall when in its closed position with predetermined limited clearance around said head so as to provide a limited opening area fixed by said clearance during a portion of the initial opening period of said valve, and said second valve having a head which is essentially unrecessed in its closed position to provide relatively unlimited opening area except as controlled by valve lift, whereby exhaust flow is restricted during the initial opening period of said first valve by passage of exhaust gases through said predetermined clearance, thus reducing the cylinder pressure by limiting flow in advance of the opening of said second valve and the wider opening of said first valve so that the exhaust blowdown pulse is controlled and exhaust noise is thereby limited.

4. The combination in an internal combustion engine of at least one cylinder having a plurality of exhaust ports through an end wall thereof, poppet valves, one for each port, actuatable to close or open their respective ports, and a camshaft driven in timed relation to engine operation and having a first exhaust cam lobe connected to actuate at least a first one of said valves and a second exhaust cam lobe connected to actuate at least a second one of said valves, said cam lobes being arranged to provide a slightly longer open period for said first valve than for said second valve, to open said first valve in advance of said second valve and to close both valves substantially coincidentally, said first valve having a head recessed in said end wall when in its closed position with predetermined clearance around said head so as to provide a limited opening area fixed by said clearance during a portion of the initial opening period of said valve, and said second valve having a head which is essentially unrecessed in its closed position to provide relatively unlimited opening area except as controlled by valve lift, whereby exhaust flow is restricted during the initial opening period of said first valve by passage of exhaust gases through said predetermined clearance, thus reducing the cylinder pressure by limiting flow in advance of the opening of said second valve and the wider opening of said first valve so that the exhaust blowdown pulse is controlled and exhaust noise is thereby limited.

* * * * *